US007213386B2

(12) United States Patent
Hooper

(10) Patent No.: US 7,213,386 B2
(45) Date of Patent: May 8, 2007

(54) DEVICE FOR FILLING A CONTAINER WITH A PLURALITY OF OBJECTS

(75) Inventor: Leon Hooper, Denistone N.S.W. (AU)

(73) Assignee: Manufacturing Solutions PTY Ltd, Denistone, N.S.W. (AU)

( * ) Notice: Subject to any disclaimer, the term of this patent is extended or adjusted under 35 U.S.C. 154(b) by 0 days.

(21) Appl. No.: 10/518,474

(22) PCT Filed: Jun. 23, 2003

(86) PCT No.: PCT/AU03/00781

§ 371 (c)(1),
(2), (4) Date: Dec. 20, 2004

(87) PCT Pub. No.: WO04/000649

PCT Pub. Date: Dec. 31, 2003

(65) Prior Publication Data

US 2005/0229548 A1 Oct. 20, 2005

(30) Foreign Application Priority Data

Jun. 21, 2002 (AU) ..... PS3072

(51) Int. Cl.
*B65B 35/12* (2006.01)
*B65B 5/10* (2006.01)
*B65B 5/08* (2006.01)

(52) U.S. Cl. ..... 53/448; 53/475; 53/542; 53/244; 53/248; 53/255; 53/261; 53/534; 53/263; 198/419.3; 414/798.2

(58) Field of Classification Search ..... 53/475, 53/542, 536, 244, 248, 255, 261, 534, 263, 53/443, 527, 260, 436, 448; 198/419.3; 414/798.2
See application file for complete search history.

(56) References Cited

U.S. PATENT DOCUMENTS 2,919,528 A * 1/1960 White ..... 53/527
3,000,151 A * 9/1961 Winkler et al. ..... 53/443

(Continued)

FOREIGN PATENT DOCUMENTS

JP 04339705 A * 11/1992
WO WO 99/43550 9/1999

*Primary Examiner*—Stephen F. Gerrity
(74) *Attorney, Agent, or Firm*—Finnegan, Henderson, Farabow, Garrett & Dunner, L.L.P.

(57) ABSTRACT

A device for filling a container with a plurality of objects standing substantially upright on a floor portion of the container includes: a depositing cavity temporarily created and maintained in the container for receiving one of the plurality of objects; a first moveable planar restraining member having a first anterior surface facing the depositing cavity and a first posterior surface, the first posterior surface restraining a previously deposited object against movement; and a second moveable planar restraining member having a second anterior surface facing the depositing cavity and a second posterior surface. The first and second restraining members are operationally arranged to be removably insertable into and between the opposing side walls of the container. After one of the plurality of objects is deposited into the depositing cavity, the first restraining member is moveable from a position on a first side of one of the plurality of objects, and the second restraining member is moveable away from the first restraining member to create a new depositing cavity.

24 Claims, 10 Drawing Sheets

U.S. PATENT DOCUMENTS

| | | | | | |
|---|---|---|---|---|---|
| 3,435,584 | A | * | 4/1969 | Prechter | 53/542 |
| 3,698,153 | A | * | 10/1972 | Lieberman | 53/260 |
| 3,890,764 | A | * | 6/1975 | Hartman | 53/542 |
| 4,031,999 | A | * | 6/1977 | Wagner et al. | 53/444 |
| 4,161,095 | A | * | 7/1979 | Buday | 53/527 |
| 4,261,158 | A | | 4/1981 | Van Kattenbroek | |
| 4,608,808 | A | | 9/1986 | Ryan et al. | |
| 4,611,705 | A | * | 9/1986 | Fluck | 53/542 |
| 4,676,050 | A | | 6/1987 | Odenthal | |
| 5,331,790 | A | | 7/1994 | Benner, Jr. et al. | |
| 5,358,232 | A | * | 10/1994 | Arendes et al. | 271/181 |
| 5,588,285 | A | | 12/1996 | Odenthal | |
| 6,145,281 | A | | 11/2000 | Hansen et al. | |
| 6,907,980 | B2 | * | 6/2005 | Iwasa et al. | 53/542 |

* cited by examiner

DEVICE FOR FILLING A CONTAINER WITH A PLURALITY OF OBJECTS

FIELD OF THE INVENTION

This invention relates to high-volume commercial packing processes and equipment. In particular, it relates to a device and procedure for sequentially guiding individual objects into a container.

BACKGROUND TO THE INVENTION

Many technologies exist for the packing of flexible packages, particularly bags or pouches, into containers. Some machines place or drop the packages flat in the container, others position the packages vertically within the container. Most of the machines available to place bags or pouches in a packing case with a vertical orientation tend to be large, expensive and capable of high speed operation.

The trend in many areas of manufacturing including the food industry is for more frequent product changeovers with shorter production runs. A concurrent trend is to reduce the number of packages in a shipping container. There is also constant economic pressure to reduce the cost, size and complexity of equipment, improve the flexibility of equipment and simplify processes.

A particular application of wide interest is the insertion of flexible bags or pouches, in one or more rows in a case or carton, where the bags or pouches are standing on end so that the top of every bag or pouch is visible from above. An ability to provide such a packing configuration, at least at moderate speed applications of up to about 140 cycles per minute is desired.

There have been numerous designs for machines to insert bags or pouches into cases such as those disclosed in US patent document Nos. U.S. Pat. No. 4,676,050 and U.S. Pat. No. 5,588,285 (by Odenthal). These overlap the bags so that as one bag is loaded vertically into a case, the top of the bag is prevented from tipping forward into the empty section of the case by the bottom of the next bag. However, the mechanism to do this includes insertion of the end of a conveyor mechanism into the case which, when withdrawn from the case after filling, leaves an unused void in the case that compromises the volume efficiency of the operation, otherwise known as 'slack fill'.

A variant of this design is disclosed in German patent document No. DE 19917657, which fills the case in a different direction and uses different methods to prepare the group of bags to be loaded to the case, but which has a similar problem of slack fill.

A fast-operating machine which avoids the problem of slack fill due to a withdrawn conveyor is disclosed by Ferris in US patent document No. U.S. Pat. No. 5,855,105. The machine relies on angling of the cases and utilising gravity to encourage the bags to sit closely together, and thereby not fall into the unloaded portion area of the case. However, it is a considerably more complex, and hence expensive, machine. The machine further relies on gravity to compress the bags within the carton.

The issue of slack fill has been recognized and addressed in various patents, for example as disclosed by Benner, Dunhoft and Smith in US patent document No. U.S. Pat. No. 5,331,790 which specifically addresses the compression of a collated group of pouches to minimize the space required in the container into which the pouches are finally inserted. This mechanism is an example of the capable but rather complex, and hence expensive, designs that have been offered for higher speed operation.

The design disclosed by Saxrud and Hansen in US patent document No. U.S. Pat. No. 6,145,281 is one example of the method of creating a collated group of bags outside the carton and then inserting the group of bags into an erected carton or else erecting the carton around the group of bags. A variety of machines that collate the bags, condition them in appropriate ways and then place them inside a carton are offered by various of manufacturers. Although very effective, they are too complex and hence expensive to be cost effective for most low speed bag production processes.

A much simpler design for larger bags that also uses a tilted case to encourage bags to remain in the orientation in which they are placed is disclosed by Adamek in German patent document No. DE 19742017. It is relatively uncomplicated, but also relies on a bag 'flying' from the end of a chute into a case and stopping in the required position in the required orientation in a consistent manner. Furthermore, subsequent bags must then find a stable position on top of the bags already loaded into the case, and sufficient clearance must be left within the case for the last bag to enter reliably. Bags filled with liquid may flex and thereby conform to the interior of the case, but bags containing solid materials are much less likely to do so solely under the influence of their own weight.

A slightly different approach is disclosed by Ryan in US patent document No. U.S. Pat. No. 4,608,808, in which bags are individually conveyed into a tilted case on a retractable conveyor. This has the same problem of slack fill, due to the space required in the case to accommodate the conveyor, as per Odenthal. It also requires the conveyor to be inserted and removed for each bag which will tend to slow down the process.

A different approach is disclosed by Didier in European patent document No. EP 1186537, where pouches are conveyed, without grouping, to special containers divided into a series of compartments. One pouch is dropped into each compartment with a subsequent process grasping the top of each of the individual pouches of a group prior to lifting the pouches out of the special container and placing them into a case. The plurality of special containers and the associated machinery costs can not usually be justified for most low speed applications.

Another approach, disclosed by Heliot in US patent document No. U.S. Pat. No. 3,425,184 is to guide individual bags into a cavity defined within a specialised case by the end, bottom and sides of said case and by the previously loaded bag restrained at its top by part of the mechanism and at the bottom by a feature of the special case. After the bag has fallen into the cavity, it is pushed along the inner surface of the case to be similarly restrained before the next bag falls into position. A plate mounted on an angled roller prevents the previously loaded bags from falling into the unused part of the case. This approach requires a special feature on the bottom of the case to restrain the lower end of the bag and also relies on a pusher to displace the bag beyond both the bottom feature and the top first restraining member of the mechanism. The pusher design requires that the bag be quite stiff and the first bag loaded will be displaced the entire length of the case, following bags must move correspondingly shorter distances within the case. Such systems are not suitable for many applications where the cost of providing a specialised case would be prohibitive, and the excessive sliding of the deposited items along the base of said container could not be reliably sustained due to the natural physical variations in said items.

To summarise the drawbacks of the prior art, each of the above described systems possesses one or more of the following features:

- A conveyor extending into the case which reduces the space available to be filled with bags (Odenthal, Ryan and DE 19917657).
- Bags or pouches are transferred into a tilted case individually (Ryan, Adamek) and gravity is relied upon to keep the bags or pouches in place. The bags must form a stable stack within the case yet the case must have sufficient width for the bags to enter easily.
- A group of pouches is transferred into a case in a single operation, which requires considerable machine complexity (Saxrud and Hansen). Many other machines are available to load cases but they tend to be complex and expensive.
- The product is placed into separate cavities in special containers to define their position prior to transfer to a case (Didier).
- The product is guided into a cavity within a case where one side of the cavity is defined by the end of the case and must then be displaced within the case to provide room for the next bag or pouch (Heliot). The case requires special construction details for this process to work.

It is an object of the present invention to provide an apparatus for automated packing of cases or cartons with vertically oriented bags or pouches, which overcomes at least some of the disadvantages of the prior art.

SUMMARY OF THE INVENTION

According to one aspect of the invention, there is provided a device for temporarily creating and maintaining a depositing cavity in a container to be filled with objects, in particular flexible packages, standing substantially upright on the floor of said container, said device including: a moveable planar first restraining member with an anterior surface facing into said cavity and a posterior surface; and a moveable planar second restraining member with an anterior surface facing into said cavity and a posterior surface; the restraining members being operationally arranged to be removably insertable into and between facing side walls of a container to be filled with upright stacked objects and thereby to define a temporary cavity which facilitates the insertion of the objects into the container. The cavity is defined, in an object receiving configuration, by facing anterior surfaces of said first and second restraining members, by facing side walls of said container and by a portion of the floor of said container delimited thereby, such that upon deposition a given object sits upon said portion of said floor and between said facing anterior surfaces. The posterior surface of said first restraining member acts to restrain previously deposited objects against movement. According to the invention so configured, following deposition of an object into said cavity, said first restraining member may be withdrawn from its position on one side of said object, and reinserted so as to take up a new restraining position on the opposite side of said object, and said second restraining member may then be moved away from said first restraining member thereby to create a new cavity for the deposition of a further object.

Such a device possesses significant advantages over the prior art, as it provides a guided entry to a controlled size cavity within the container, where the cavity dimensions may be set slightly larger than the object, and may be set to a consistent size. This greatly assists in allowing a repeatable and consistent deposition of objects that may themselves have inconsistent dimensions and shapes.

The restraining, after loading, of the objects already within the container tends to provide some compression of the objects, thereby reducing the potentially unused space within the container. The invention also allows the creation of a suitable cavity via equipment that itself need not take up significant volume within the container. The present invention also allows consistent packing operation, due to the exclusion of previously deposited objects from the cavity, thereby preventing interference with the object entering the cavity.

Restraining the objects via a compressive loading may also tend to redistribute the contents of the objects for some products and thus increase the number of objects that can be reliably and consistently loaded into a container of given dimensions.

Upon filling of a container with objects, both the first and second restraining members may be withdrawn from the filled container. Therefore, removal of the full container and replacement with an empty container, before both members resume the insertion operation, should not require a pause in the supply of objects, except possibly for very high speed operation or if the empty or filled containers are especially difficult to move quickly.

A mechanism according to the invention, due to its mechanical simplicity, may also be installed at a much lower capital cost, compared with some of the prior art devices.

The mechanism provided by the invention also allows objects to be dropped into the container in a substantially vertical manner, which assists greatly in achieving positive insertion of the object into said container, by comparison with the angled-feed approach of some prior art devices.

Preferably, the first and second restraining members are at least partly defined by a comb-like structure, consisting of successive teeth and gaps, and said first and second restraining members are disposed relative to one another such that the teeth of the first restraining member are aligned in a plane with the gaps between the teeth of the second restraining member, thereby to allow, following deposition of a package into said cavity and withdrawal of said first restraining member from its position on one side of said object, said first restraining member to be inserted through said second restraining member in an interleaving manner so as to take up a new restraining position on the opposite side of said object.

Such an embodiment greatly increases the efficiency and consistency with which the first restraining member may be repositioned with respect to the just-deposited object.

Advantageously, the surfaces of the restraining members are treated to reduce their coefficient of friction, thereby reducing their tendency to pull the objects upward as they are withdrawn.

Alternatively, the teeth may be formed from rod material.

Preferably, the first restraining member is mounted on a moveable articulated arm, and is pivotally connected to said arm such that the centre of gravity of the first restraining member is substantially directly beneath the centre-line of said pivot. If the centre of gravity is not directly beneath the pivoted joint, the rapid upward motion of said member during withdrawal will tend to induce a rotation about the pivot, which may contribute to a higher likelihood of pulling an object or objects out of the container as the member is withdrawn.

Preferably, in said object receiving configuration, said first restraining member is actively biased such that its posterior surface acts to place said previously deposited objects under compression, sufficient to prevent said objects from losing their deposited orientation with respect to each other and to the container. Advantageously, this compression may be released immediately prior to withdrawal of said first restraining member from said case, reducing the likelihood that objects will be unintentionally withdrawn from the container.

Preferably, in said object receiving configuration, said first and second restraining members are disposed within said container such that said portion of said container floor represents substantially the final position of said object in said container, thereby obviating any requirement for the deposited object to be subsequently repositioned. This is especially advantageous, in that considerable difficulties may be encountered in trying to drag or slide some objects along the floor of the container.

Preferably, in said object receiving configuration, said first and second restraining members are disposed within said container such that said cavity tends to taper inward toward said floor of said container. Advantageously, in said object receiving configuration, one or both of said first and second restraining members is arranged to allow pivoting movement of its lower extremity away from the other of said first and second restraining members, and wherein a bias against said pivoting movement is provided. This assists in effecting the guiding of the base of the object toward its intended position. It also tends to allow a braking force to be exerted on an object falling into said cavity, while allowing said cavity to expand to accommodate said object. This is especially useful for heavier, or bulging, objects, as well as for delicate objects.

A particularly advantageous embodiment is provided wherein, during said insertion of said first restraining member through said second restraining member, a cradle is formed between said anterior surfaces of said first and second restraining members. Such a cradle may be capable of catching and holding one of said objects as it falls, arresting its inopportune entry into the container, but allowing an object so captured to enter the next formed cavity as it forms. This allows the invention to operate with no requirement for providing a gap in the supply of objects, for a variety of object sizes and shapes, which is a significant advantage over the prior art.

Where the objects are relatively stiff, ie unlikely to 'slump', and do not require significant compression to restrain their movement, it is advantageous to provide a first restraining member wherein the posterior surface of said member only contacts an upper portion of the previously deposited objects to restrain them against movement. This would require a shorter stroke of the first restraining member during the cavity re-creation sequence, with a consequent higher maximum operating speed. In such an embodiment, the second restraining member applies most of the force required to displace the last object guided into the container during creation of a cavity for the next object.

Operational reliability and production efficiency of packing machinery is very important. Simplicity of operation which assists rapid diagnosis of the cause of a problem, ease of adjustment and the ability to self clear many types of production blockage without stopping the machine and causing lost production are benefits of the invention. The relatively simple motions required of the object (falling, e.g. down a chute, into a defined cavity, being displaced slightly within the container, and then being restrained within the container until the container loading is completed) provides improved reliability of operation and is an important operational benefit provided by the invention.

As the object may be allowed to fall in a substantially vertical trajectory into the container, and is guided by the sides of the cavity as it falls, the depositing operation can be done with very high reliability for most objects, provided they have greater than negligible mass and reasonably smooth surfaces. Even difficult objects can be managed at lower speeds due to the positive restraint applied to the loaded objects by the restraining members during the entire loading process.

The core area of application of the present invention is food products packed in objects or pouches that are required to be packed on end within a container, and which have sufficient weight to enable the falling object or pouch to be guided with reasonable consistency. This invention has application where insertion rates are not especially high, for example less than about 140 items per minute, but where an automated packing method is desired. The invention is particularly suitable for food products because in the food industry both the type of product to be packed and the package sizes tend to be changed regularly, placing a premium on flexibility of operation and an ability to handle variable packages.

The invention is particularly applicable to lower cost installations for objects and pouches that have very little stiffness and require contact from top to bottom to restrain the objects already loaded. Other areas of application will be apparent to persons skilled in the art.

In another aspect of the invention, there is provided a method of depositing objects into a container, including the steps of:

positioning an open container in a filling position relative to a device as described above;

inserting said first and second restraining members into said container in said object receiving configuration, thereby creating a deposition cavity disposed to receive said object;

causing an object to drop into said cavity;

withdrawing said first restraining member at least partly from said container;

reinserting said first restraining member into said container such that it takes up a new restraining position on the opposite side of said object such that it restrains both the most recently deposited object and all previously deposited objects from movement;

moving said second restraining member away from said first restraining member thereby to create a new cavity for the deposition of a further object;

repeating the above cycle until said container is filled;

withdrawing said first and second restraining members from said container;

removing filled container from said filling position; and repeating the above sequence.

Preferably, where the device is provided with a sensor or sensors able to detect if the cavity formed is clear of any object previously guided into the container, if these sensors detect a object has not been correctly displaced to the other side of the first restraining member, the cavity re-creation cycle may be repeated if there is sufficient time before the next object is expected.

The process of removing a filled container and placing an empty container in its place at higher operating speeds may require more time than a single cycle.

In an alternate embodiment, if a sensor or sensors detect that the cavity presented within the container for the next object is obstructed and has not or can not be cleared by repeating the normal machine cycle, the mechanism can withdraw from the container and in nearly all instances, the obstruction will be left behind. The next empty container is moved into place and the mechanism enters this container, forming a cavity ready to guide the next object into the container. The previous container that has not been filled correctly may be removed to a different destination from correctly filled containers, where it may receive attention from an operator.

Preferably, this process of detecting and clearing a malfunction of object guidance will neither require stopping the supply of objects nor interrupt the packing of containers and will affect only a minimum number, usually one, of containers.

In another aspect of the invention, there is provided a packaging line for filling containers with objects, including a device as defined above.

Now will be described, by way of a specific, non-limiting example, a preferred embodiment of a device according to the invention.

DETAILED DESCRIPTION OF A PREFERRED EMBODIMENT

It will be understood by those skilled in the art that the present invention can be implemented in a number of different ways. The preferred embodiment will now be described with reference to the figures.

Figure 1:
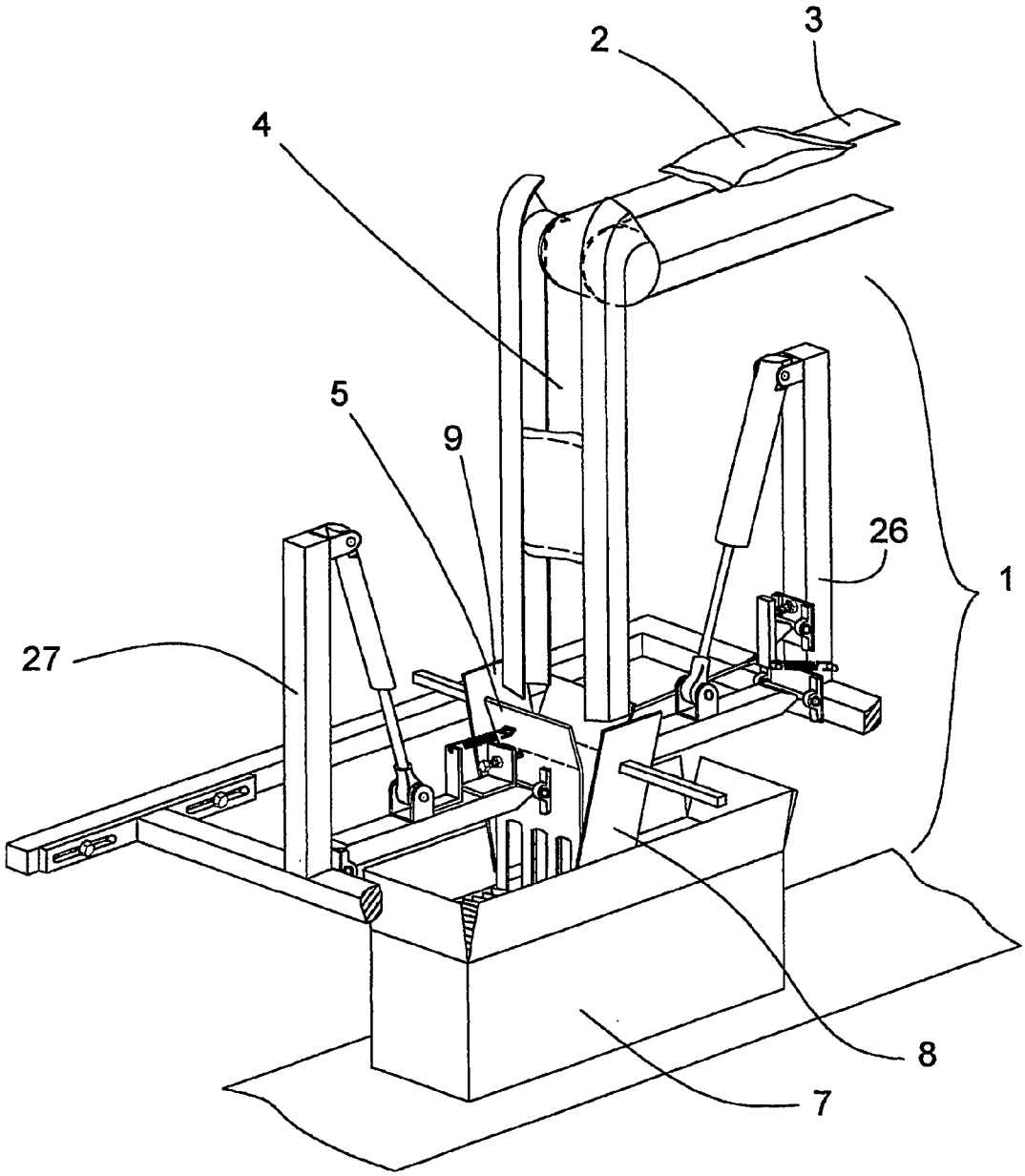
FIG. 1 shows a general view of the mechanism with a conveyor for supplying product, and a container positioned for loading.
Figure 2:
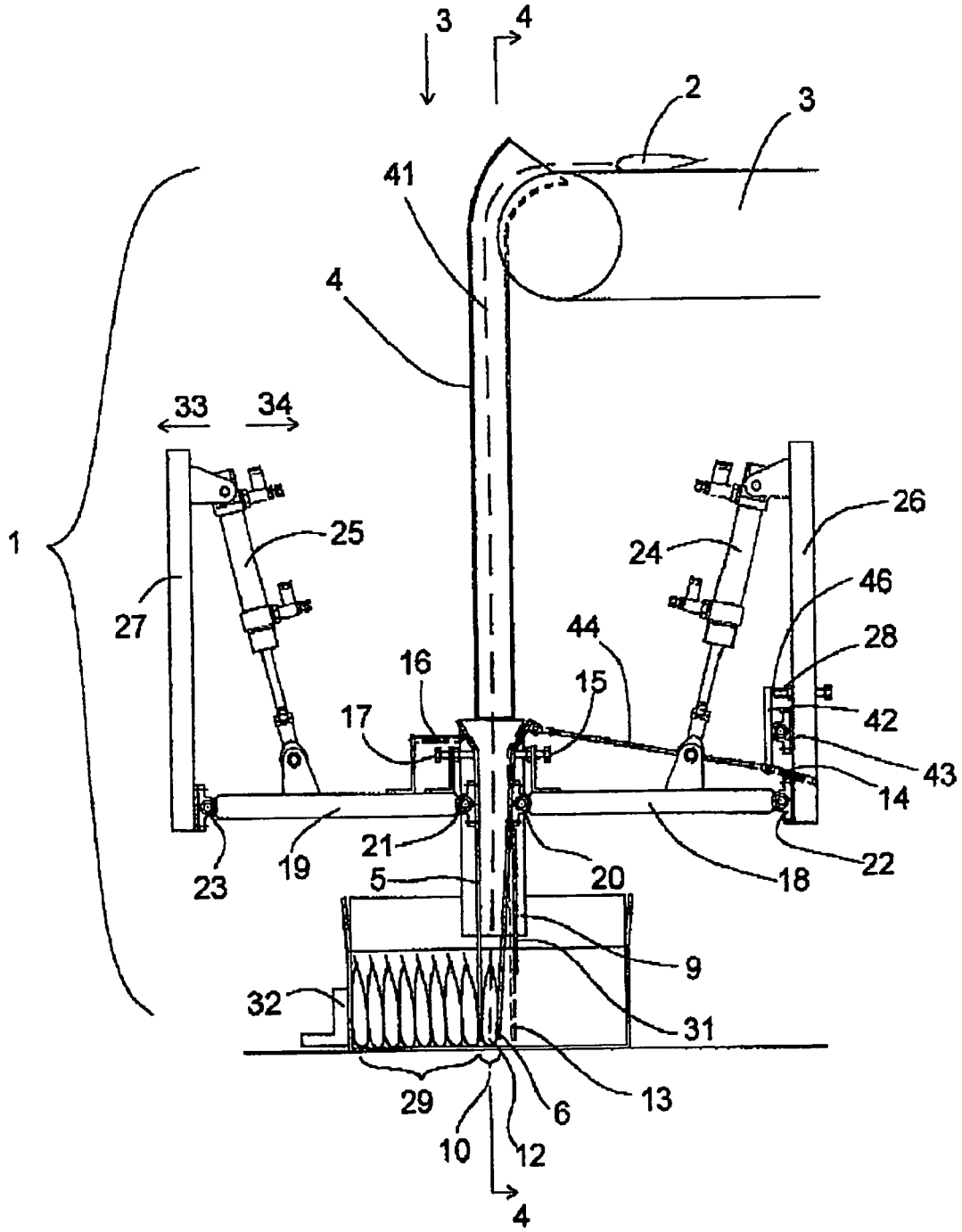
FIG. 2 shows a partial cross section of the mechanism.

Referring to FIGS. 1, 2, 3 and 4, there is shown a device 1 for guiding flexible bags 2 from a conveyor 3 into a shipping container 7. A chute 4 is provided to guide the bags 2 from the conveyor 3 to the working elements of the device 1. The device consists essentially of a first moveable restraining member 5, having an anterior surface 5*a* and a posterior surface 5*b* and a second moveable restraining member 6, having an anterior surface 6*a* and a posterior surface 6*b*. The gap between the surfaces 5*a* and 6*a* defines a moveable cavity 10 into which the bags 2 are guided. A bag 12 is shown in FIG. 2 having been guided into position at the floor of the container 7.

Figure 5:
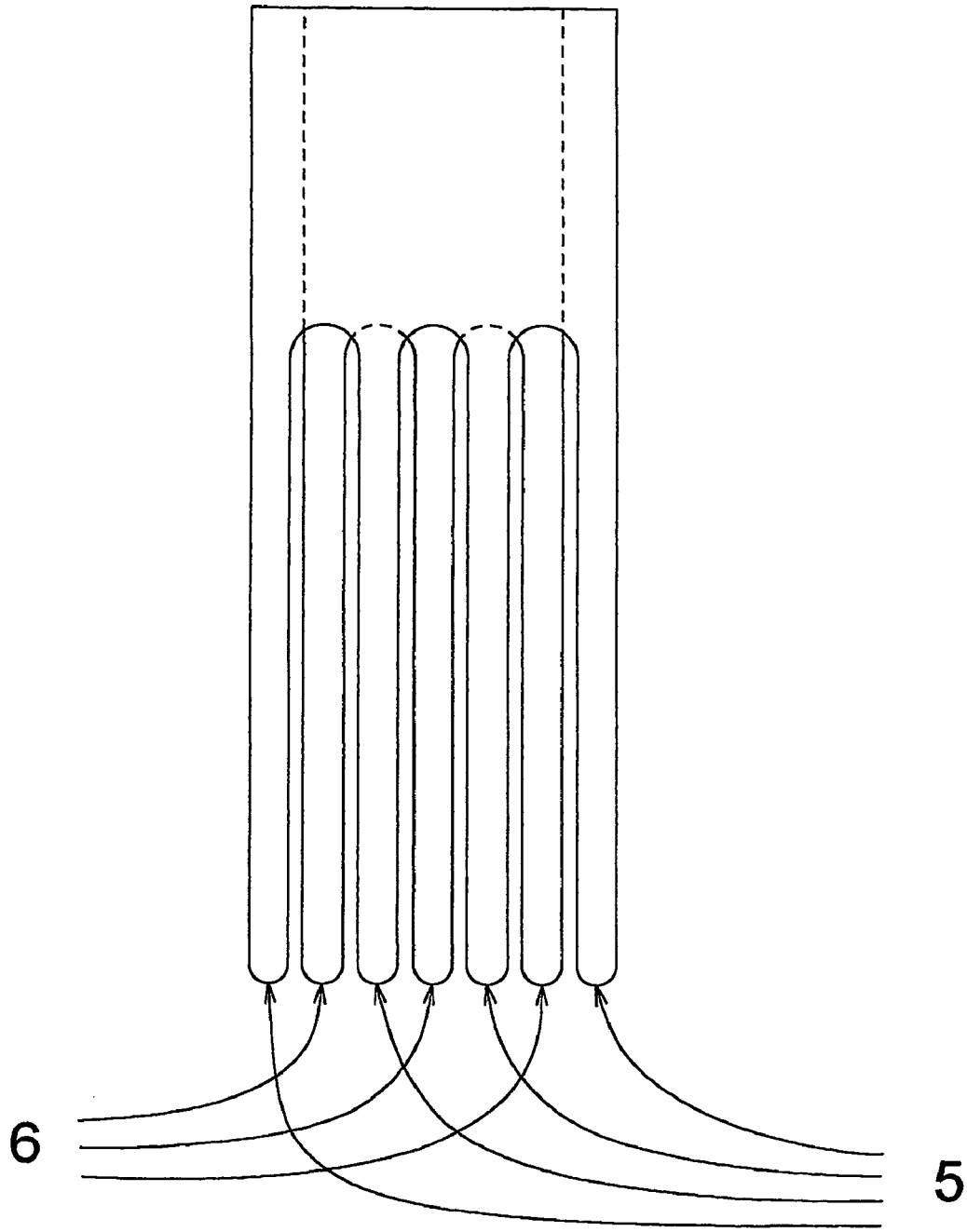
FIG. 5 shows a view of the restraining and second restraining members aligned with one another, indicating the relative proportions that enable interleaving of the first and second restraining members.
Figure 8:
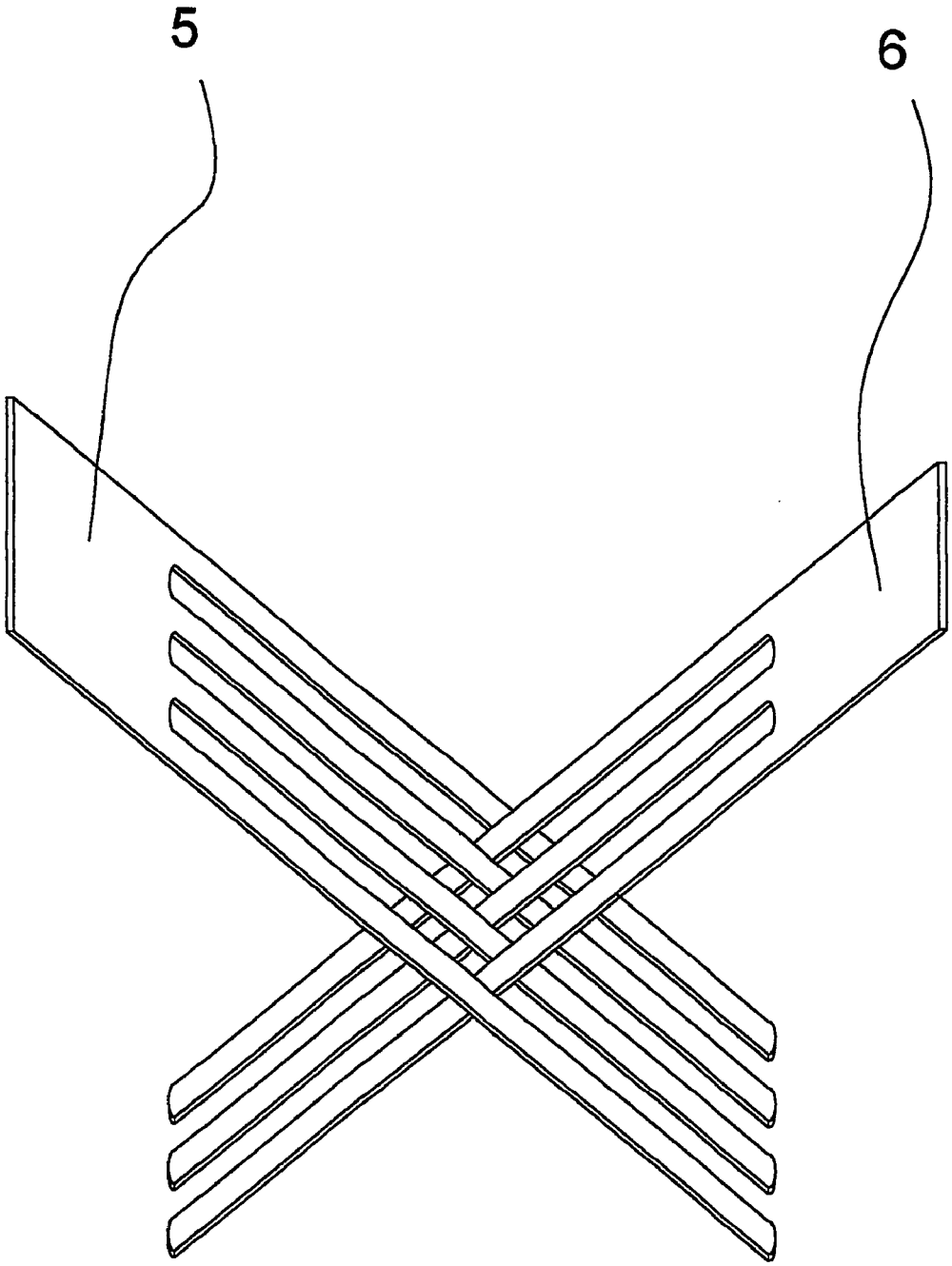
FIG. 8 shows the interleaving of the first and second restraining members when both are raised as per FIG. 7.

The first and second restraining members 5, 6 are attached to mechanically operated sub-assemblies that actuate the various operational movements of the device as described below. Said restraining members are characterised by a comb-like structure which is illustrated in FIGS. 5 and 8. The structure allows the members to assume a 'cross-over' interleaving configuration as shown in FIG. 8.

It will also be noted that the restraining members are pivoted slightly toward each other, causing the cavity 10 to taper inward toward the container floor.

Now will be outlined the operational features of the device. Referring to FIGS. 1, 2, 3 and 4, bags 2 containing product are conveyed along conveyor 3. The bags 2 have been created by a bagging mechanism, not shown, and deposited on the conveyor 3 in the required orientation.

The bags 2 are conveyed to the end of the conveyor 3 where they enter the first part of the mechanism 1 by falling into a chute 4 which has nominally parallel sides, although these may be slightly tapered, and which guides and aligns the bags 2 as they fall towards the cavity 10. The dashed line 41 indicates the nominal path the bag 2 will follow as it falls to the bottom of the cavity 10. Below the chute 4, the cavity 10 is defined primarily by the anterior surfaces 5*a* and 6*b* of the first restraining member 5 and the second restraining member 6. The floor of the container 7 defines the bottom and lower sides of the cavity 10 within the container 7, with the side plates 8 and 9 defining the upper sides of the cavity 10. The side plates 8 and 9 provide a continuity of side guidance from chute 4 into the container 7 and hold the container flaps 11 clear of the bag trajectory 41.

Figure 4:
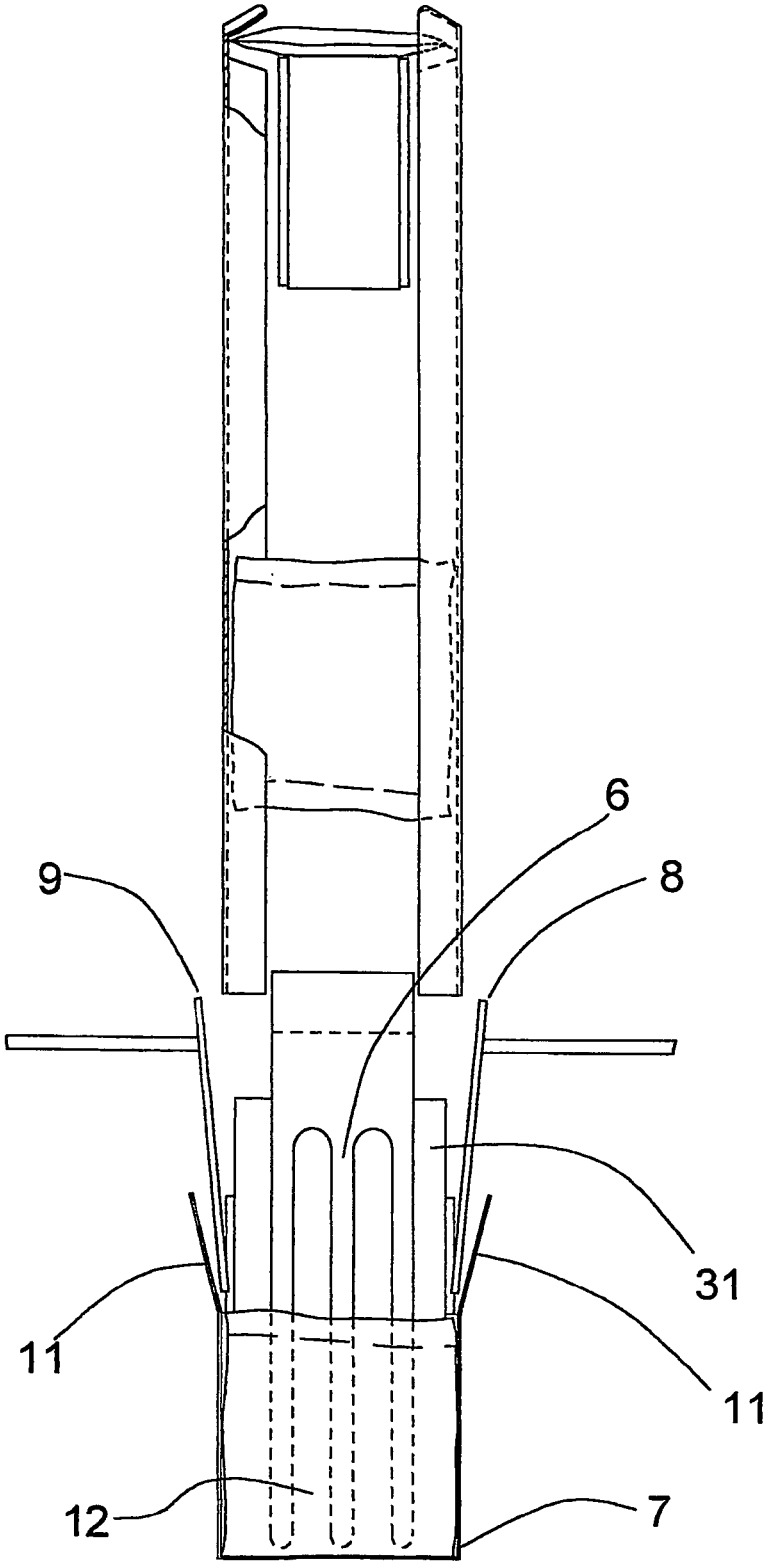
FIG. 4 shows a cross-sectional end view in the direction 4—4 of FIG. 2.

The action of falling down the chute 4 provides the bag 2 with some momentum which assists the bag 2 in quickly reaching the bottom of the cavity 10. FIGS. 2 and 4 show a bag 12 at the bottom of the cavity 10.

Further detail in relation to the specific configuration of the above described features will now be given, followed by a description of the bag deposition and cavity re-creation cycle that is, performed by the device embodying the invention.

Figure 3:
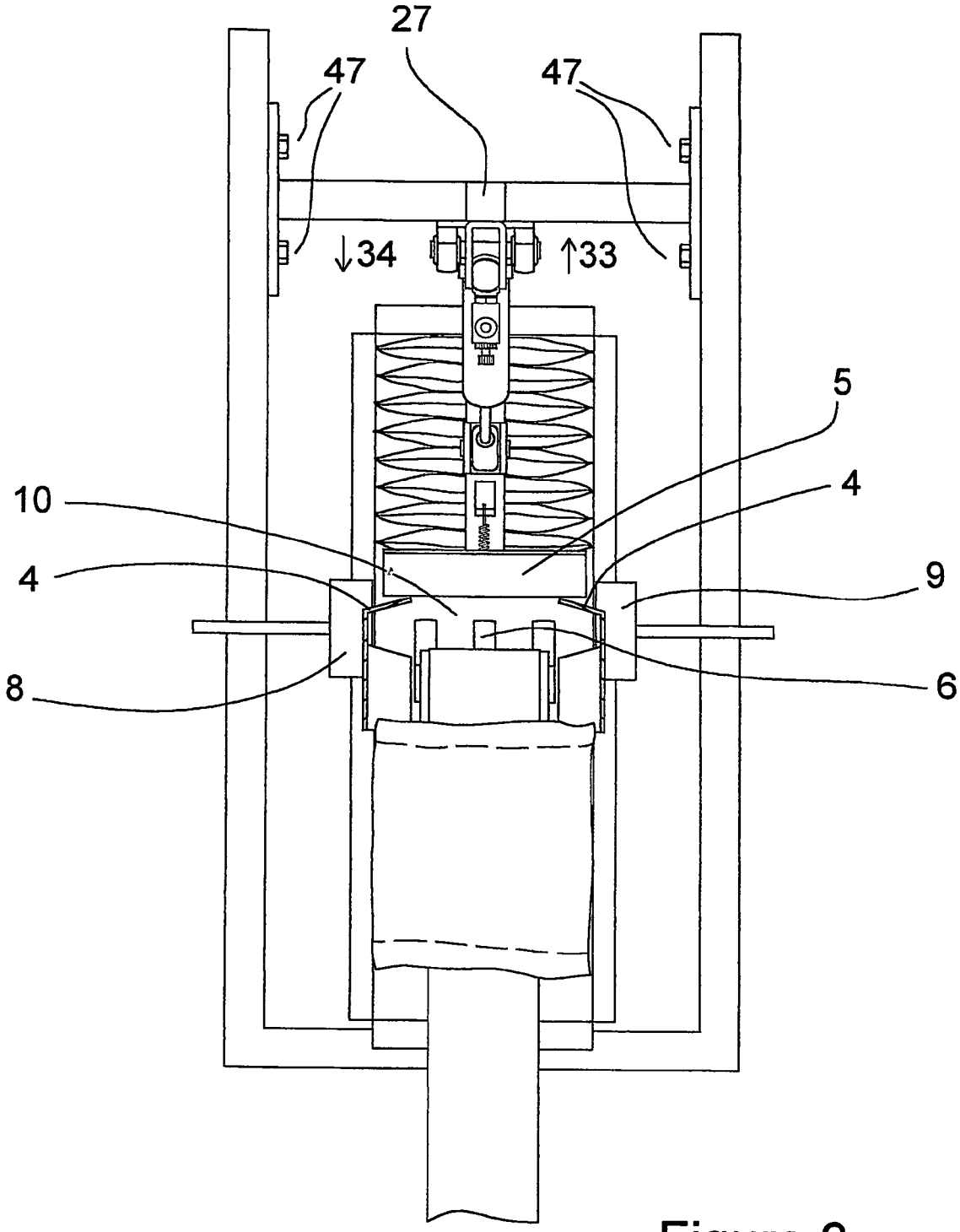
FIG. 3 shows a view of the mechanism from above in the direction 3 of FIG. 2, with the bag removed for clarity.

FIG. 2 shows the construction details of the mechanism 1. The first restraining member 5 is attached by the bearing 21 to the arm 19 which is attached by the bearing 23 to the sub-frame 27. The sub-frame 27 may be moved in the direction 33 to increase the width of cavity 10, or moved in the direction 34 to decrease the width of cavity 10. These adjustments in the directions 33 or 34 are a means of adjusting the mechanism 1 to pack bags or pouches of different thickness. The bolts 47 are shown in FIG. 3 clamping the sub-frame 27, being one method of providing this adjustability. Alternatively, the length of the arm 19 could be adjusted to change the width of the cavity 10.

The actuator 25 retracts to raise the first restraining member 5 and extends to lower it. When the actuator 25 is extended and the first restraining member 5 is in a lowered position, and acting to compress and thereby restrain the group of bags already loaded 29 to the container 7, the precise position of the first restraining member 5 is controlled by the adjustment screw 17, which also resists the reaction load from the bags 29. The adjustment screw 15 may be used to adjust the minimum width of the cavity 10 but is more useful for adjusting the angle of the second restraining member 6 as it commences to apply a compressive force to the bag 12. The adjustment screw 28 is set at a gap 46 to the rocker bar 42, mounted on bearing 43. This controls the position of one end of the linkage rod 44, which acts to limit the maximum backwards motion of the member 6 to the nominal position 13. The spring 14 tends to pull the member 6 back against the adjustment screw 15.

When the arm 19 rotates upward, the first restraining member 5 rises and would tend to remain substantially vertically oriented if not for the action of spring 16. When the first restraining member 5 first starts to rise, the geometry of the mechanism and the action of the restrained bags on the first restraining member 5 ensures that the adjustment screw 17 immediately loses contact with the first restraining member 5 and the spring 16 imposes little initial force on the first restraining member 5. As the arm 19 continues to rotate upward, the extension of the spring 16 and hence the force it applies to the first restraining member 5 increases.

The second restraining member 6 is connected by the bearing 20 to the arm 18, which is in turn connected by the bearing 22 to the machine frame 26. The actuator 24 extends to lower the second restraining member 6 and retracts to raise it when the container 7 has been filled so the filled container 7 can be removed and replaced.

When the actuator 24 is extended, the arm 18 is rotated down to its lowest position as shown in FIG. 2 and the second restraining member 6 is inserted in the container 7.

The forward position of the second restraining member 6 is controlled by the adjusting screw 15 and the spring 14. These elements act together to produce a tapering of the cavity 10 toward its lower end, which assists in depositing the bag 12 such that its base lands as close as possible to the lower extremity of the first restraining member 5. The spring 14 is comparatively soft so that a falling bag 2 can deflect the second restraining member 6 to widen the cavity 10 if necessary. This action may also impart a gentle braking force to a falling bag.

The adjustment screw 28, which acts through the linkage of rocker arm 42 and linkage arm 44, tends to limit the movement of the second restraining member 6 so that it can support both the bag 12 and the restrained bags 29 for part of the cavity re-creation cycle. The adjustment screw 28 also provides some control of the position of the second restraining member 6 as the actuator 24 retracts and extends. The linkage arm 44 is angled relative to the arm 18 so that as the arm 18 starts to rise, the influence of the adjustment screw 28 on the position of the member 6 decreases to allow the spring 14 a larger range of movement.

Figure 6A:
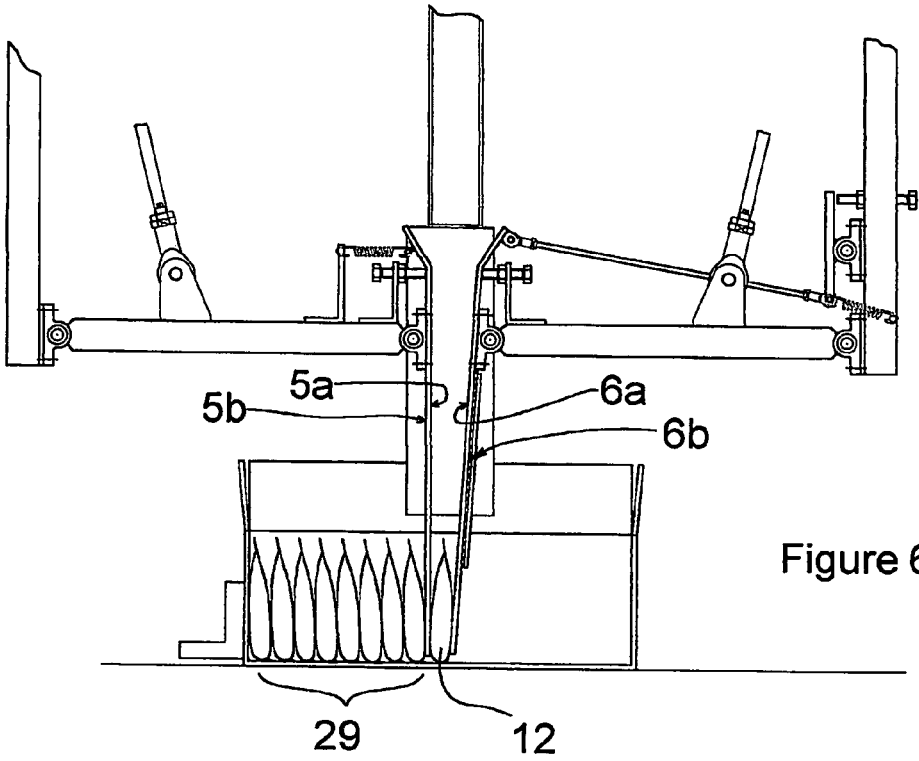
FIG. 6*a* shows the first and second restraining members of the mechanism at the start of the bag and container displacement and cavity re-creation cycle, with a bag at the bottom of the cavity defined within the container by the mechanism.
Figure 6B:
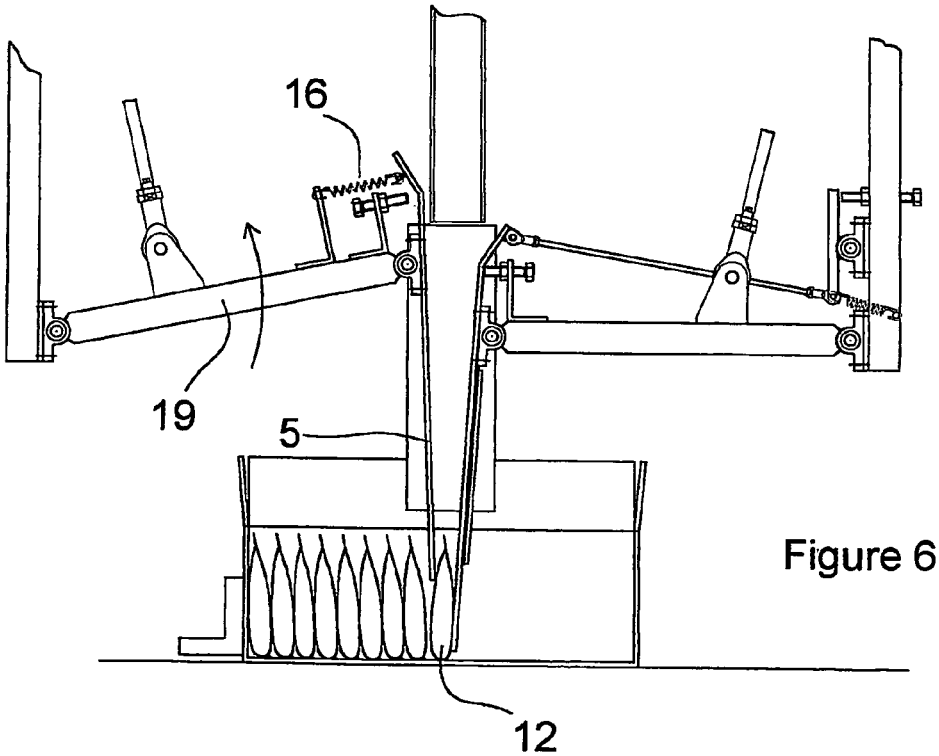
FIG. 6*b* shows the first restraining member partly raised with the lower edge still guided by the last bag to enter the cavity.
Figure 6C:
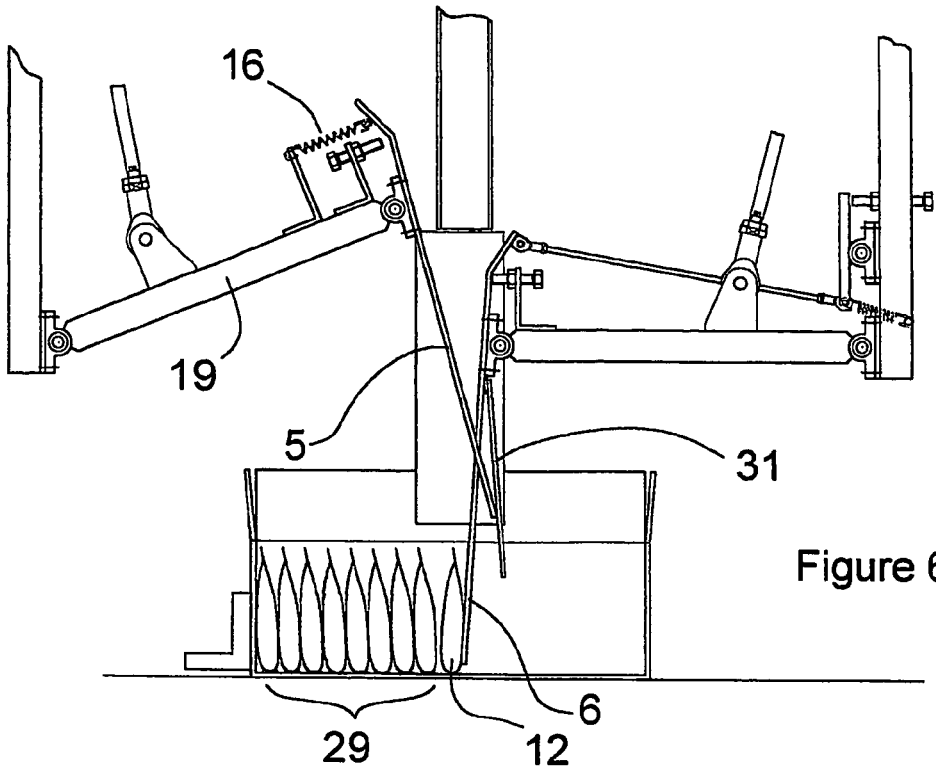
FIG. 6*c* shows the first restraining member raised, with the lower edge positioned beyond the top of the last bag to enter the cavity. An optional, separately supported flap mounted behind the second restraining member to keep the end of the first restraining member within the container when loading the last few bags is also shown.

The optional plate 31, which is mounted flexibly below bearing 20 and may swing relatively freely, is advantageous when inserting the last few bags in a container. It should protrude into the container 7 proper, below the fold line of the end flap. FIG. 6*c* shows the plate 31 deflected as the first restraining member 5 moves beyond the top of the bag 12 as part of the cavity re-creation cycle. For the second and possibly third last bag 2 to be loaded to the container 7, the ends of the first restraining member 5 may tend to extend beyond the end of the container 7. The bottom of the plate 31 will be restrained by the end of the container 7 and so the plate 31 guides the ends of the first restraining member 5 down and into the container 7. Plate 31 is preferably made of a suitably slippery plastic material, which may also be flexible, thereby removing the need for separate hinges or bearings to support the plate 31.

FIG. 3 shows the clear path for the bag 2 to travel down into the chute 4 and hence into the cavity 10. FIG. 4 shows a bag part way down and being guided by the sides of the chute 4. This is the normal path the bag 2 should follow. FIG. 4 also shows a bag 12 at the bottom of the cavity 10. (Please note: in normal operation, there would not be two bags in the precise positions shown in FIG. 4, these are shown as an illustration of bag positions during different parts of the operating cycle of the device).

FIG. 5 shows both the first and second restraining members of the mechanism as they are aligned when the cavity 10 is presented. The long 'finger-like' extensions of the lower end of both members 5, 6 are proportioned so that the first restraining member 5 may interleave with the second restraining member 6. FIG. 8 provides a view of this interleaving when both are raised for the removal of a filled container and its replacement with an empty container, as per FIG. 7. As shown in FIG. 5, the first restraining member 5 has four such extensions, in this example, and is shown slightly less wide than the bag 12 and the container 7. Any suitable number of extensions for members 5 and 6 may be chosen, provided they provide the described interleaving functionality.

The second restraining member 6 has three extensions in this example, and is shown to be narrower than the first restraining member 5. The second restraining member 6 acts to guide a falling bag 2, and then supports the deposited bag 12. For part of the bag displacement and cavity re-creation cycle, as the first restraining member 5 is momentarily withdrawn, the second restraining member 6 must also provide support for the group of bags 29 already deposited in the container 7. The first restraining member 5 must displace the bag 12, the other bags already loaded 29, and the container 7 at the end of the bag displacement and cavity re-creation cycle. The first restraining member 5 should support as much of the bag 12 as possible and should have only a small clearance between the outside perimeter of the first restraining member 5 and the inside of the container 7, in order to minimize any opportunity for a bag 12 to move around the first restraining member 5, rather than be displaced by it.

The clearance allowed between the lower extremities of the first restraining member 5 and the container floor should be set such that the bags do not slide underneath it during operation. An appropriate clearance for a given bag would be readily determined by the person skilled in the art, as would other aspects relating to tuning the position of the restraining members for given bag shapes and sizes. The container 7 may also require outside support (not shown) of the container sides so that these do not bulge.

If a wider or narrower bag is to be packed, the positions of the side plates 8 and 9 must be altered and the first restraining member 5 and the second restraining member 6 may need to be replaced with wider or narrower plates. This may be achieved either by changing the members or adding or removing individual fingers or rods as required to guide and support the bags. The plate 31 will probably have to be changed if the container 7 width is modified. However, it is anticipated that the mechanism should function correctly for a moderate range of bag widths, without requiring that the first restraining member 5 and the second restraining member 6 be changed.

Generally speaking, as the top-to-bottom length of the bag 12 to be packed reduces, or as the depth of the container 7 decreases, no change to the first restraining member 5 or the second restraining member 6 would is expected to be necessary, but the side plates 8 and 9 may need to be changed or repositioned appropriately, and the plate 31 might also need to be varied in such circumstances. Again, the person skilled in the art would readily comprehend and supply such adjustments as are necessary.

Although an overall large-scale version of mechanism 1 could be adjusted to run very small product, its heavier weight would limit its maximum speed to less than a smaller-scale mechanism 1 could achieve.

Now will be described the bag deposition and cavity re-creation cycle to be performed by the inventive device.

When the bag 12 has reached the bottom of the cavity 10, the bag displacement and cavity re-creation cycle can begin. This is illustrated in FIGS. 6*a*, 6*b*, 6*c*, 6*d* and 6*e*. FIG. 6*a* shows the bag 12 at the bottom of the cavity 10 with the first restraining member 5 in its 'wait' position. FIG. 6*b* shows the first restraining member 5 partially withdrawn from between the bag 12 and the restrained bags 29. The spring 16 applies little or no loading to the first restraining member 5 during the initial part of the cycle to allow the first restraining member 5 to float freely and apply minimal force to either of the bags it is touching, thereby minimizing any tendency for the first restraining member 5 to pull these bags upward and out of the container. The upward motion due to rotation of the arm 18 caused by retraction of the actuator 25 should be very rapid and the surfaces of the first restraining member 5 should ideally be quite smooth to further minimize any tendency for the first restraining member 5 to pull a bag up out of the container 7.

FIG. 6*c* shows the first restraining member 5 after it has been fully withdrawn from between the bag 12 and the group of restrained bags 29. The spring 16, which is very lightly loaded initially, starts to apply more force to the first restraining member 5 as the arm 19 is raised higher which will cause the extremities of the first restraining member 5 to interleave with the second restraining member 6. If the upward motion of the arm 19 which supports the first restraining member 5 is rapid, inertial effects due to the rotation of arm 19 for a balanced first restraining member 5 will act in unison with the spring 16 to position the first restraining member 5 as shown in FIG. 6*c* when the bag 12 is not close to the end of the container 7.

Figure 6D:
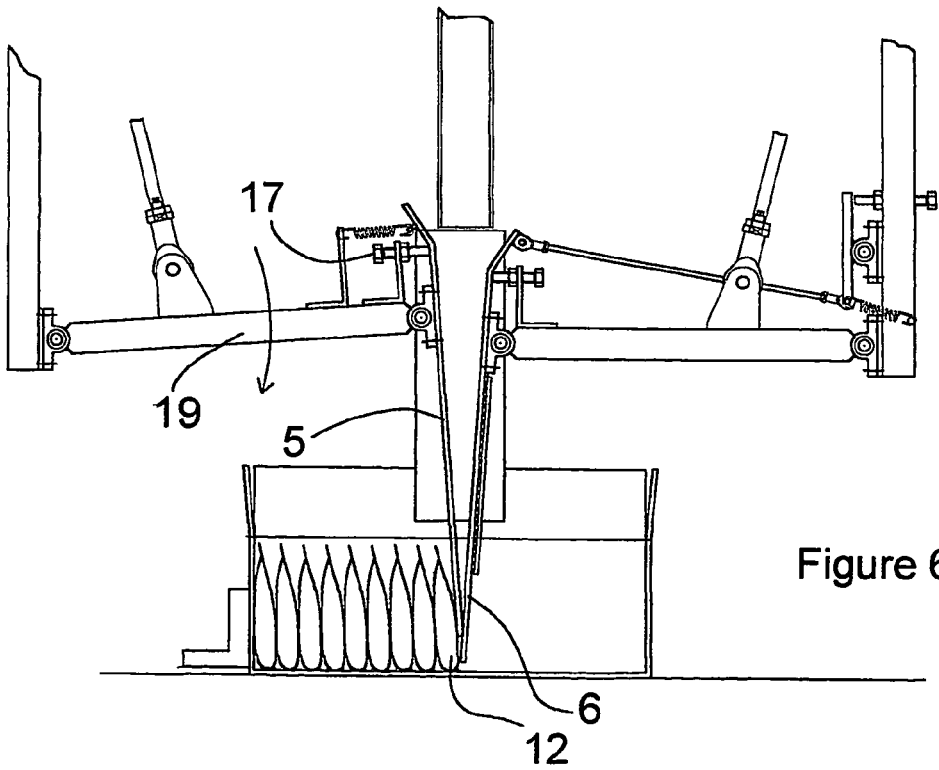
FIG. 6*d* shows the first restraining member moving down behind the last bag loaded to the cavity prior to displacing it and re-creating the cavity.

FIG. 6*d* shows the first restraining member 5 moving downwards beyond the bag 12. The actual position of the first restraining member 5 will be determined by a combination of the force applied by spring 16, the effects of gravity and inertial loadings on the mass of the first restraining member 5, the position of plate 31 (if close to the end of the container 7) and the positions of the arm 19 and the adjustment screw 17. During this part of the motion, the first restraining member 5 will contact the bag 12 with sufficient pressure to overcome all of the above factors other than the position of the arm 19 and the adjustment screw 17.

The adjustment screw 17 should be adjusted so that the first restraining member 5 is substantially vertical when the first restraining member 5 begins to apply pressure to bag 12 to displace it and the container 7 so that the cavity 10 may begin to be re-created for the next bag to be guided into the container.

Figure 6E:
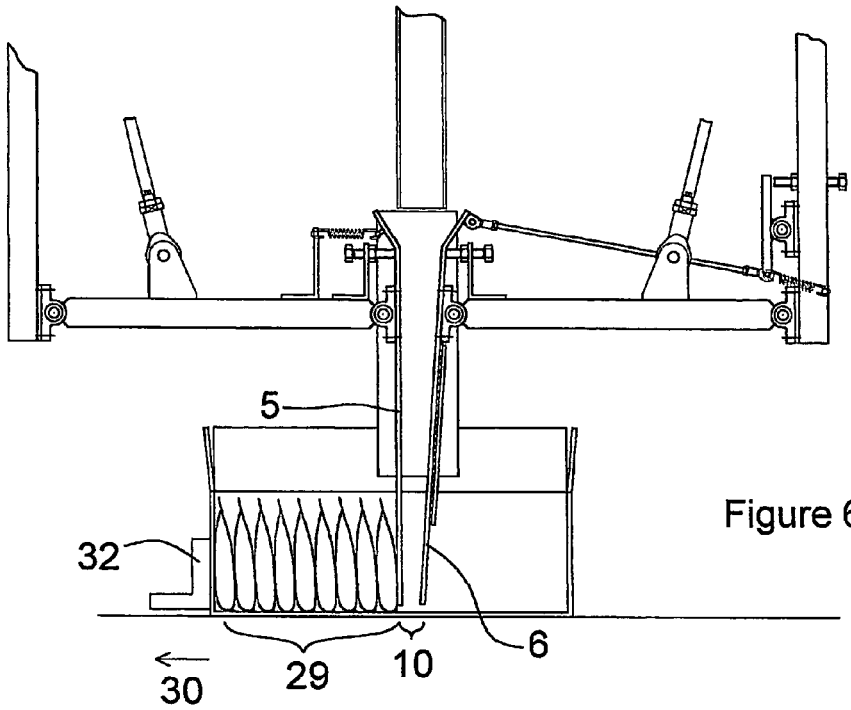
FIG. 6*e* shows the first restraining member at the end of cycle position with the cavity re-created with the last bag loaded into the cavity now on the other side of the first restraining member. The container has also been displaced by a suitable amount.

The arm 19 and hence the first restraining member 5 will continue to move a little further as the bag 12 is displaced but the position of the bearing 23, the geometry of the arm 19 and the relative position of the first restraining member 5 should apply a predominantly horizontal loading to the bag 12 to move it, the other bags 29 and the container 7, the displacement 30 shown in FIG. 6*e* at which point bag 12 becomes one of the restrained bags 29, and the cavity 10 is re-created, ready to accept a new bag.

The container restraint 32 tends to apply force to the end of the container 7 during the filling process to prevent the container 7 from continuing to move after the first restraining member 5 has finished displacing the last loaded bag 12, the restrained bags 29 and the container 7. The container restraint 32 can function in two ways. If the container restraint 32 only resists movement in the direction shown by the displacement 30, the container 7 will not move when the first restraining member 5 is withdrawn during the bag displacement and cavity recreation cycle.

If the container restraint 32 applies a constant force to the container 7, the container 7 will move backwards when the first restraining member 5 is withdrawn during the bag displacement and cavity re-creation cycle. The container restraint 32 will transfer its force to the container 7, thereon to the restrained bags 29, thereon to the bag 12 and thereon to the second restraining member 6. This will tend to move the second restraining member 6 until the adjusting screw 28, acting on the back of the rocker arm 42 via the linkage rod 44, stops the motion. This has two consequences which may be desirable when packing some products, the container 7 and the restrained bags 29 will oscillate slightly back on every cycle which may help to redistribute the contents of the bags 29 for some materials so that more bags 2 can be loaded to the container 7. The compression of the bag 12 by the group of bags 29 before the first restraining member 5 begins to displace the bag 12 may also tend to improve the reliability of operation of the device for some products.

The pneumatic cylinder 25 is shown defining the lower position of the first restraining member 5 in combination with the adjustment screw 17. The amount of upward travel required for the first restraining member 5 to clear the top of the bag 12 or to clear the end flap of the container 7 when changing containers may be varied as appropriate. The longer stroke for full retraction may be appropriate for many types of bags, but will tend to be slower. An actuator or actuators with an intermediate position may be used for faster operation. If the intermediate position required to clear the top of the bag 12 can be detected, switching the valve for the cylinder 25 to change to the downward stroke may be the simplest, most reliable and easily adjusted configuration for the sequential cavity recreation cycles that do not involve exchanging one container with another.

The arms 18 and 19 ideally should be capable of relatively rapid movement. The pneumatic cylinders 24 and 25 are shown providing the limits of travel. For a sufficiently large cylinder of an appropriate design, the internal stops of the cylinder will be able to cope with the forces imposed when the downward motion is stopped. To reduce the effect of gravity, a spring or springs (not shown) could be mounted to assist the cylinder lift the arm and help slow its downward motion, thus reducing the effects of gravity for the cylinders.

For an end of container retraction, the cylinder 25 would be allowed to retract fully to raise the first restraining member 5 high enough to clear the end flaps of the container 7. Not all containers will have an end flap.

The positioning of the bottom of the bag 12 close to the bottom of the first restraining member 5 may impart a slight tilt to the bag 12 so that the first restraining member 5 will begin to move the bag 12 later in the bag displacement cycle, with less downward movement and predominantly horizontal movement. If the bag 12 is both heavy and sags within the cavity 10, the initially tilted position described greatly reduces any tendency for the bag 12 to stick to the bottom of the container 7 and jam underneath the first restraining member 5, rather than be displaced by the first restraining member 5 at the end of its cycle. The reason this initial positioning helps to avoid this problem is that it minimizes the distance the bottom of the bag 12 will be moved during the cycle, as well as predisposing the bag to any small necessary movement in the direction required. For stiffer or lighter bags, the bag 12 will be very easy to displace with the first restraining member 5.

For heavy bags that sag, a stiffer spring 14 for the second restraining member 6 will help to support the bag 12 within the cavity 10.

Figure 7:
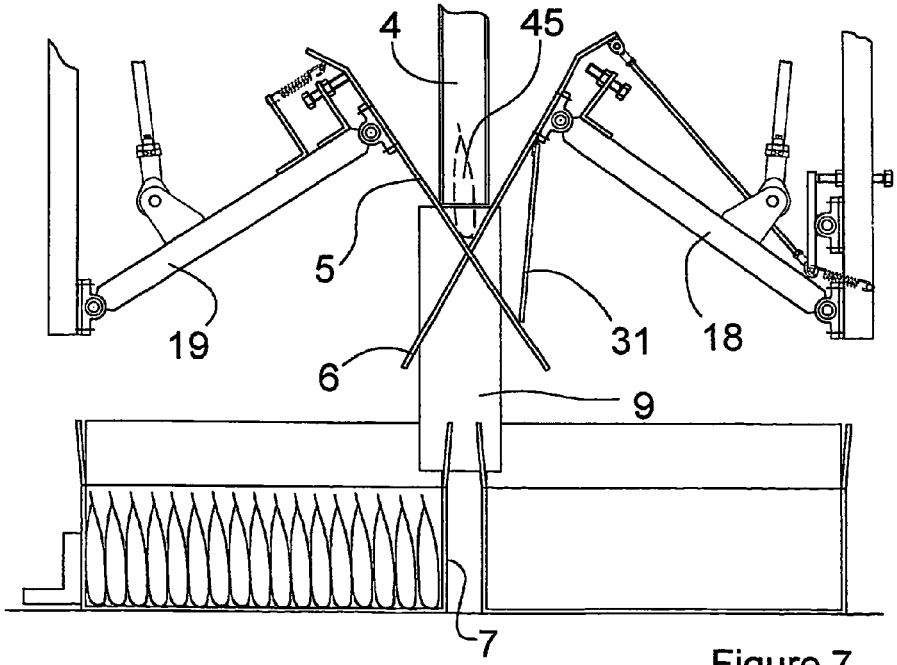
FIG. 7 shows both the restraining and second restraining members in the raised position which allows the filled container to be moved away and another empty container placed beneath the mechanism. A bag is also shown supported on the interleaved first and second restraining members, which will be lowered into position in the empty container as the cavity is re-created.

FIG. 7 shows the first restraining member 5 and the second restraining member 6 in the retracted up position that allows a filled container to be removed and the next empty container to be put in place. The figure also shows the interleaving of the lower portions of the two restraining members. For the initial downward movement of the restraining members 5, 6 into an empty container 7, the container will be presented moved forward several bag widths so that the ends of member 6 do not catch on the end flap of container 7. If the container restraint 32 is enabled to move the container 7 backwards, it should be controlled to do so after the members 5 and 6 have first descended into the container. If the container restraint 32 alternatively only limits forward motion of the container 7, the first few bags loaded to the container will not be compressed, but as more bags are loaded into the container, the bags will tend to be stood upright, compressed and will start to move the container along as force is applied by the first restraining member 5. The design of the assembly of linkage arm 44 and rocker arm 42, combined with the setting of the adjustment screw 28, will help to limit the forward rotation of the second restraining member as it descends into the container 7. If the container restraint 32 applies constant force, then the gap 46 should also be smaller to reduce the extent of the movement of the second restraining member 6 provided the product can redistribute itself within the bag. This applies particular to bags with liquid contents.

The side plates 8 and 9 are preferably positioned so that, provided the next container to be loaded has its long-side flaps opened as it first moves beneath the side plates 8 and 9, these will then control the position of the side flaps until the container has been filled and pushed clear (FIG. 7). If the containers to be loaded have no side flaps, then either the side plates 8 and 9 may be positioned with their lower edges just above the container so that no bag 2 will fall onto the upper edges of the container 7, otherwise the side plates 8 and 9 may be pivoted and moved (by actuators not shown) clear of the container 7 when loading has finished, and moved down into the container 7 when the next empty container has moved into position, prior to the first bag being guided into the new container.

The pivoting movement of the side plates 8 and 9 may also be beneficial if full and empty containers are to be concurrently moved sideways while the first and second restraining members are raised. There are of course a multiplicity of different methods by which a filled container can be removed and an empty container positioned to receive the next bag, many of which will be familiar to the person skilled in the art. For some of these methods, the ability to raise the side plates 8 and 9, as well as the first and second restraining members, is at least desirable.

The chute 4 can provide some guidance for the bags 2 but the bags 2 must be presented consistently on the conveyor 3. If the bags 2 are deposited on the conveyor 3 by a mechanism, this should provide sufficient consistency. The narrowness of the conveyor belt relative to the bag allows various methods for aligning bags, checking bag alignment and rejecting bags to be used. For a different size of bag 2, it may be necessary to adjust the chute 4 or replace it with another.

FIG. 8 is a view of the first restraining member 5 and the second restraining member 6 when both are raised as in FIG. 7, showing the interleaving ability of this configuration.

Figure 9:
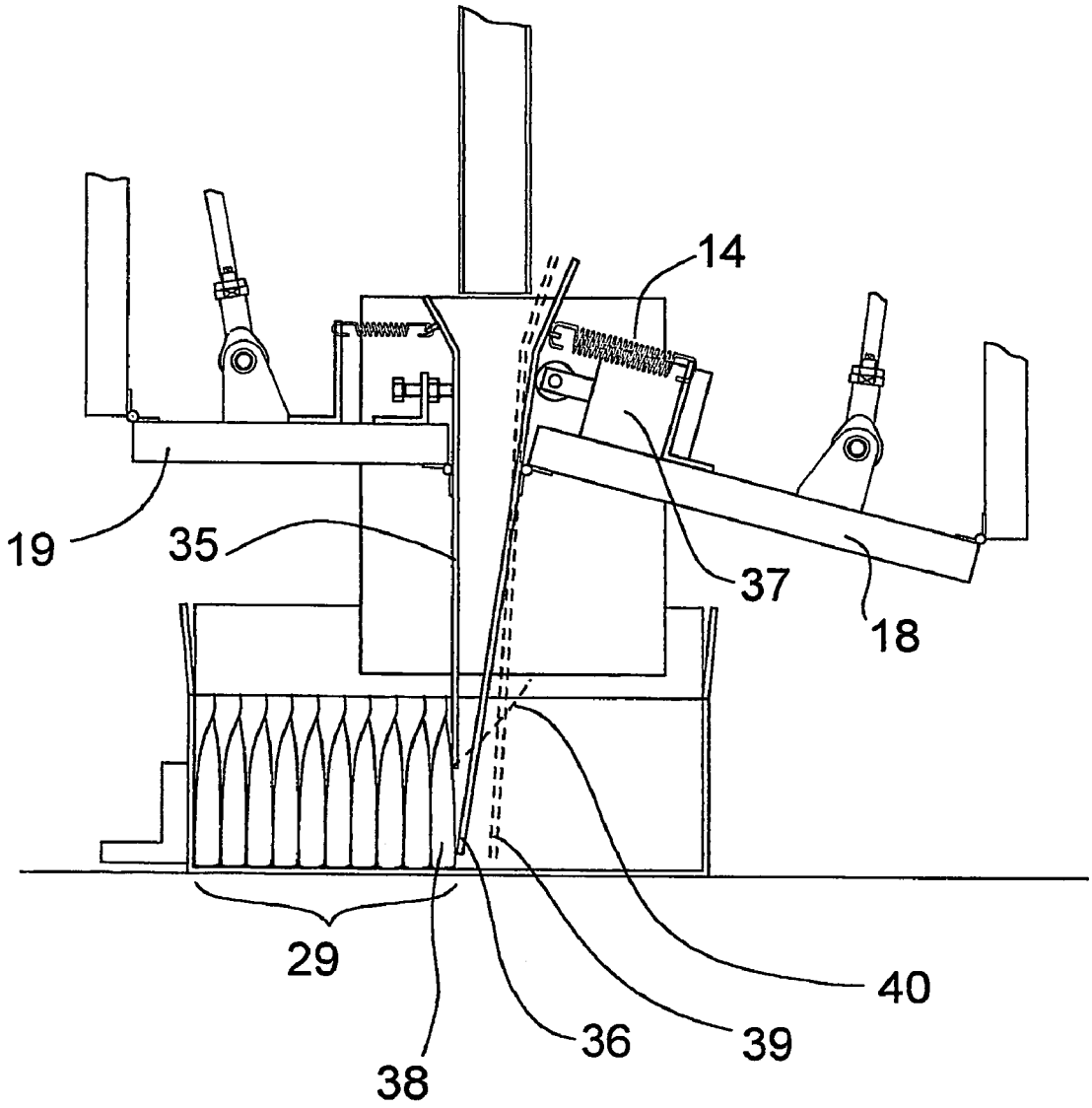
FIG. 9 shows an alternate embodiment for relatively stiffer pouches that requires a shorter motion to displace a bag loaded to the cavity within the container so that an empty cavity may be very quickly presented to the next bag. Hinges are used instead of bearings and other details are also different to illustrate the variety of construction approaches that may be employed.

FIG. 9 shows an alternate embodiment suitable for faster operation with stiff, slippery bags or pouches that will not tend to slump and which require only minimal or no compressive force to be applied by the posterior surface of the first restraining member. The first restraining member 35 is shorter and its range of motion during the bag displacement and cavity re-creation cycle will be less, thereby allowing faster operation.

The cavity 10 relies upon the last bag loaded 38 to form one side of the cavity 10. The cycle requires a smaller but similar movement of the restraining plate 35 to displace the top of the bag 12. The displacement cycle also requires a driven movement of the opposing plate 36. The bottom of the bag 12, the restrained bags 29 and 38, and the container 7 are displaced by the bottom of the opposing plate 36 moving from the position indicated by the dotted outline 39 to the position shown. The cavity 10 is fully defined just before the bag 2 reaches the container 7 by the actuator 37 extending in opposition to spring 14 to move the lower extremity of the opposing plate 36 to the position indicated by the dotted outline 39. Spring 14 must be very stiff because it provides the force to displace the bags 12, 29, 38 and the container 7 and then maintains restraint on the bags 29 through bag 38. When the bag 12 has been moved, it becomes bag 38 and forms one side of the cavity 10.

The arm 19 is shorter and the dotted line 40 indicates the movement downward of the first restraining member 35 during the displacement of the bag 12 as it moves to become bag 38. If the arm 19 were as long as shown in the earlier figures, the first restraining member 35 would have to be longer to be certain of always engaging on the other side of the bag 12, which would require a longer and hence slower movement of the first restraining member 35.

FIG. 9 shows this alternate embodiment using hinges, rather than bearings. These are cheaper and lighter but do not have as long an operational life. The arm 18 is mounted at an angle with the frame 26 slightly lower than the sub-frame 27 to alter the movement of the second restraining member 6 on withdrawal from the container 7 after filling it. These differences, as compared to the other figures, could equally be applied to the embodiments presented above.

Further increases in the speed of the mechanism could be realized using cams or four bar linkages, possibly with servo control, to allow very rapid controlled movements with smaller acceleration loadings than are feasible with the simple mechanism actuators shown.

Persons skilled in the art will perceive additional modifications and embodiments of the invention that nevertheless fall within the inventive concept.

The invention claimed is:

1. A device for filling a container with a plurality of objects standing substantially upright on a floor portion of the container, the device comprising:

a depositing cavity temporarily created and maintained in the container for receiving one of the plurality of objects;

a first moveable planar restraining member having a first anterior surface facing the depositing cavity and a first posterior surface, the first posterior surface restraining a previously deposited object against movement;

a second moveable planar restraining member having a second anterior surface facing the depositing cavity and a second posterior surface;

a first arm for repositioning the first restraining member from a position on a first side of the one of the objects to a new restraining position on an opposing second side of the one of the objects after the one of the objects is deposited into the depositing cavity;

a second arm for maintaining the second restraining member in a position for guiding the one of the objects during deposition into the depositing cavity and maintaining the deposited object in a deposited position while the first restraining member is being repositioned;

wherein the depositing cavity is defined in an object receiving configuration by the first and second anterior surfaces, the floor portion of the container, and opposing side walls of the container, wherein the first and second restraining members are at least partially defined by a comb-like structure including successive teeth and gaps, the first and second restraining members being arranged in a manner such that the teeth of the first restraining member are aligned in a plane with the gaps between the teeth of the second restraining member, thereby allowing the first and second restraining members to interleave as the first restraining member moves to the new restraining position on the opposing second side of the one of the objects, and wherein the first and second restraining members are operationally arranged to be removably insertable into and between the opposing side walls of the container.

2. The device of claim 1, wherein the surfaces of the first restraining member are treated to reduce their coefficient of friction.

3. The device of claim 1, wherein the first restraining member is pivotally connected to the first arm.

4. The device of claim 3, wherein the second restraining member is pivotally connected to the second arm.

5. The device of claim 4, wherein a centre of gravity of the second restraining member is substantially directly beneath the centre-line of the pivot.

6. The device of claim 4, wherein the first and second arms raise the first and second restraining members, respectively, above an upper level of the container in an interleaving arrangement to form a cradle for catching and holding one of the plurality of objects above the upper level of the container.

7. The device of claim 3, wherein a center of gravity of the first restraining member is substantially directly beneath a centre-line of the pivot.

8. The device of claim 1, wherein in the object receiving configuration, the first restraining member is actively biased such that the first posterior surface acts to place the previously deposited objects under compression, sufficient to prevent relative movement amongst the plurality of objects.

9. The device of claim 8, wherein the compression may be reduced immediately prior to a withdrawal of the first restraining member from the container.

10. The device of claim 1, wherein in the object receiving configuration, the first and second restraining members are disposed within the container such that their lower extremities are positioned adjacent to the floor portion of the filled container, which represents substantially the final position of the plurality of objects in the container, thereby reducing any requirement for the deposited objects to be subsequently repositioned.

11. The device of claim 10, wherein in the object receiving configuration, the first and second restraining members are disposed within the container such that the depositing cavity tends to taper inward toward the floor portion of the container.

12. The device of claim 11, wherein an actuator displaces a bottom edge portion of the second restraining member toward a bottom edge portion of the first restraining member to create the tapered depositing cavity.

13. The device of claim 12, wherein the actuator provides the second restraining member with a force for restraining previously deposited objects in the depositing cavity while the first arm is being repositioned.

14. The device of claim 12, wherein the actuator provides the second restraining member with a force for displacing the container and previously deposited objects by a distance to at least partially create a new depositing cavity.

15. The device of claim 1, wherein in the object receiving configuration, at least one of the first and second restraining members is arranged to allow a pivoting movement of its lower extremity away from the other of the first and second restraining members, and wherein a bias against the pivoting movement is provided such that a braking force may be exerted on the object falling into the depositing cavity, while allowing the depositing cavity to expand to accommodate the object.

16. The device of claim 15, wherein both the first and second restraining members are arranged to allow the pivoting movement of their lower extremities away from each other, and wherein a bias against the pivoting movement is provided to both the first and second restraining members.

17. The device of claim 15, wherein the bias is provided by a spring-loading mechanism.

18. The device of claim 1, wherein during an insertion of the first restraining member through the second restraining member, a cradle is formed between the first and second anterior surfaces of the first and second restraining members, respectively, to catch and hold one of the plurality of objects.

19. The device of claim 1, wherein the plurality of objects fall into the depositing cavity solely via force of gravity.

20. The device of claim 1, wherein the plurality of objects are relatively stiff, and wherein the first posterior surface of said first restraining member contacts an upper portion of the previously deposited objects to restrain them against movement.

21. The device of claim 1, further comprising:

a freely pivoting plate attached to the upper posterior surface of the second restraining member.

22. A method of depositing a plurality of objects into a container, the method comprising:

positioning the container in a filling position relative to a device for depositing the plurality of objects, the device including first and second moveable planar restraining members at least partially defined by a comb-like structure including successive teeth and gaps, the first and second restraining members being arranged in an interleaving manner;

inserting the first and second restraining members into the container in an object receiving configuration to create a depositing cavity for receiving the plurality of objects;

dropping one of the plurality of objects into the depositing cavity;

withdrawing the first restraining member from the container while the second restraining member maintains restraint of the previously deposited object;

reinserting the first restraining member into the container in a new restraining position on an opposing second side of one of the plurality of objects to restrain both the most recently deposited object and all previously deposited objects from relative movement with respect to the container floor;

repositioning the container and all the previously deposited objects by actuating movement of the first restraining member to the object receiving configuration to at least partially create a new depositing cavity;

repeating the above cycle until the container is filled;

withdrawing the first and second restraining members from the container;

removing the filled container from the filling position; and repeating the above sequence.

23. The method of claim 22, wherein the depositing cavity is tapered inward toward the lower extremities of the first and second restraining members.

24. The method of claim 22, wherein when the first and second restraining members are withdrawn from the container, the first and second restraining members are arranged in the interleaving manner above an upper level of the container for catching and holding the one of the plurality of objects above the upper level of the container.

* * * * *